US011459770B1

(12) United States Patent
Gotfredson et al.

(10) Patent No.: US 11,459,770 B1
(45) Date of Patent: Oct. 4, 2022

(54) METAL WALL PANEL SYSTEM

(71) Applicants: Gary E. Gotfredson, Jasper, GA (US); Erik Gotfredson, Canton, GA (US); Shawn Morvay, Villa Rica, GA (US); Jeremy A. Manchester, Douglasville, GA (US)

(72) Inventors: Gary E. Gotfredson, Jasper, GA (US); Erik Gotfredson, Canton, GA (US); Shawn Morvay, Villa Rica, GA (US); Jeremy A. Manchester, Douglasville, GA (US)

( * ) Notice: Subject to any disclaimer, the term of this patent is extended or adjusted under 35 U.S.C. 154(b) by 0 days.

(21) Appl. No.: 16/731,112

(22) Filed: Dec. 31, 2019

Related U.S. Application Data

(60) Provisional application No. 62/834,454, filed on Apr. 16, 2019.

(51) Int. Cl.
*E04F 13/08* (2006.01)
*E04F 13/12* (2006.01)

(52) U.S. Cl.
CPC ..... *E04F 13/0835* (2013.01); *E04F 13/0803* (2013.01); *E04F 13/12* (2013.01)

(58) Field of Classification Search
CPC .... E04F 13/0835; E04F 13/12; E04F 13/0803
USPC ..... 52/506.05
See application file for complete search history.

(56) References Cited

U.S. PATENT DOCUMENTS 199,075 A * 1/1878 Leslie ..... E06B 7/14 52/97
841,490 A * 1/1907 Leslie ..... E04B 2/88 52/591.2
1,696,443 A * 12/1928 Michaelis ..... E04F 13/12 52/314
1,716,626 A * 6/1929 De Vol ..... E04F 13/12 52/591.1
1,807,667 A * 6/1931 Milleville ..... E04F 13/12 52/717.06
1,980,906 A * 11/1934 Bretland ..... E04F 13/12 52/506.06
2,044,216 A * 6/1936 Klages ..... E04F 13/0803 52/774
2,061,263 A * 11/1936 Wells ..... E04F 13/12 52/211
2,649,172 A * 8/1953 Allen ..... E04C 2/08 52/591.4
2,851,134 A * 9/1958 Robinson, Jr. ..... E04F 13/12 52/506.1
3,131,513 A * 5/1964 Grigas ..... E04F 13/0803 52/520

(Continued)

*Primary Examiner* — Brian D Mattei
*Assistant Examiner* — Joseph J. Sadlon
(74) *Attorney, Agent, or Firm* — Gerben Perrott PLLC; Benjamin M. Hanrahan

(57) ABSTRACT

A rain screen metal wall panel system is disclosed herein. Specifically, the system is directed to a metal wall panel assembly that includes a plurality of metal panels with a tab and slot design that accurately aligns the panels in three axes simultaneously. This increases the speed of installation while maintaining a properly aligned finished wall surface, join distances, and reduces cost by eliminating unnecessary clips and rails. The bottom panel(s) of the metal wall panel system of at least one embodiment includes a flat or generally planar bottom edge, with an attachment zee connection to the support structure.

17 Claims, 11 Drawing Sheets

(56) References Cited

U.S. PATENT DOCUMENTS 3,233,382 A * 2/1966 Graveley, Jr. ..... E04F 13/0864 52/522
3,477,187 A * 11/1969 Alberta ..... E04F 13/0803 52/346
4,034,528 A * 7/1977 Sanders ..... E04D 3/352 52/404.4
4,047,349 A * 9/1977 Aguilar, Jr. ..... E04F 13/18 52/553
4,288,958 A * 9/1981 Chalmers ..... E04F 13/0864 52/478
4,435,933 A * 3/1984 Krowl ..... E04F 13/0864 52/309.1
4,441,297 A * 4/1984 Rijnders ..... E04F 13/0803 52/478
4,962,612 A * 10/1990 Kuwano ..... E04F 13/0733 52/506.06
5,009,051 A * 4/1991 Trezza ..... E04B 1/6806 52/309.4
5,094,057 A * 3/1992 Morris ..... E04D 3/3603 411/340
5,136,823 A * 8/1992 Pellegrino ..... E04D 1/2916 52/592.1
5,228,257 A * 7/1993 Bowersox ..... E04B 2/72 52/588.1
5,305,570 A * 4/1994 Rodriguez ..... E04D 1/2916 52/520
5,845,440 A * 12/1998 Matsuyama ..... E04B 2/88 52/235
5,934,033 A * 8/1999 Matsuyama ..... E04B 2/88 52/235
6,134,855 A * 10/2000 Beck ..... E04D 3/30 52/519
6,216,410 B1 * 4/2001 Haberman ..... E04B 1/02 52/591.1
6,324,807 B1 * 12/2001 Ishiko ..... E04F 13/0835 52/506.01
6,351,920 B1 * 3/2002 Hopkins ..... F24F 8/10 52/506.08
6,694,694 B2 * 2/2004 Zeeff ..... E04C 2/08 52/506.01
6,883,288 B1 * 4/2005 Harbin ..... E04F 13/18 52/521
7,089,708 B1 * 8/2006 Bostock ..... E04F 13/0864 52/592.1
7,127,869 B2 * 10/2006 Perry ..... E04F 13/0864 52/747.1
7,748,188 B2 * 7/2010 Ito ..... E04F 13/0846 52/506.06
7,930,865 B2 * 4/2011 Barlow ..... E04F 15/087 52/741.11
7,963,493 B2 * 6/2011 Vardaro ..... A47F 5/10 248/241
8,336,273 B2 * 12/2012 Enns ..... E04F 13/0842 52/588.1
9,803,372 B2 * 10/2017 Griffiths ..... E04F 13/083
9,869,096 B2 * 1/2018 Brochu ..... E04F 13/0803
9,903,122 B2 * 2/2018 Naylor ..... E04F 13/0846
10,190,320 B2 * 1/2019 Naylor ..... E04F 13/0805
10,689,850 B2 * 6/2020 Langeveld ..... E04B 9/06
2005/0223666 A1 * 10/2005 Forster ..... E04F 15/16 52/392
2007/0056238 A1 * 3/2007 Albracht ..... E04F 13/0864 52/522
2007/0277464 A1 * 12/2007 Takayasu ..... E04F 13/12 52/506.01
2010/0263314 A1 * 10/2010 MacDonald ..... E04F 13/12 52/506.05

* cited by examiner

METAL WALL PANEL SYSTEM

CLAIM OF PRIORITY/CROSS-REFERENCE TO RELATED APPLICATION

The present application is based on and a claim of priority is made under 35 U.S.C. § 119(e) to provisional patent application Ser. No. 62/834,454, filed on Apr. 16, 2019, the contents of which are incorporated herein in their entirety by reference.

FIELD OF THE INVENTION

The present invention is generally directed to a rain screen metal wall panel system, and specifically to a metal wall panel system with a tab and slot attachment assembly that accurately aligns a plurality of panels in three axes (e.g., x-axis, y-axis and z-axis) simultaneously. This increases the speed of installation while maintaining a properly aligned finished wall surface, joint distances, and reduces cost by eliminating unnecessary clips and rails. The bottom panel(s) of the metal wall panel system of at least one embodiment includes a flat or generally planar bottom edge, with an attachment bracket or attachment "zee" connection to the support structure.

BACKGROUND OF THE INVENTION

Rain screen systems are known in the art and are often described as including an outer layer of material, often in the form of metal panels, that are installed along the outside surface of a building and which are designed to shed or deflect water or other weathering. Installation (e.g., labor) and production costs of such systems can be high, particularly for large installations, projects and/or buildings.

As an example, in instances where an installation job requires panels of a large dimension, e.g., 40 inches tall and 120 inches wide, the thickness, gauge or material of the panels used may not allow for the panels to be larger than a particular size, for example, 20 inches tall, due to structural integrity concerns. In such a case, either the panels will have to be reduced in size, and thereby increased in number, or stiffeners will need to be added in order to increase the integrity of the panels. Either way, the costs of the job will be increased, and the initial intent and design will need to be changed.

It can also be difficult, laborious and/or time consuming to make sure the panels, e.g., adjacent panels in the horizontal (x-axis) or vertical (y-axis) direction are aligned properly. If The panels are not aligned properly in the x- and y-axes along the facade of the building, the final installation will not only look unprofessional, but the final wall screen system may not provide the appropriate water or weather protections as desired. Additionally, in many installations, the front surfaces of adjacent panels must be flush or aligned with one another, which can be difficult, laborious and time consuming. In other words, even if adjacent panel are properly aligned in the x- and y-axes, in many cases they must also be aligned in the z-axis (perpendicular to the building) such that the front facing surfaces of the panels are aligned.

There is thus a need in the art for a wall panel system that can be easily manufactured, easily installed and which maintains a high degree of structural integrity, even in large panel installations. The proposed wall panel system of the present invention includes, among other items, a tab and slot attachment assembly and bottom zee attachment structure that reduces labor costs, production costs and can allow for the use of thicker gauge materials. This, in turn, minimizes or eliminates the needs for added stiffeners or modification of the panel size, particularly in large panel installation projects.

SUMMARY OF THE INVENTION

The present invention is generally directed to a rain screen metal wall panel system. Specifically, the wall panel system includes a plurality of wall panels assembled and installed to the outer surface of a building, including but not limited to commercial buildings, office buildings, etc. The wall panel system of the present invention is or can be considered a rain screen system or rain screen cladding, which is an outer layer of material designed to shed water from the exterior surface of the building. The panels can be arranged in a number of different configurations along the exterior of the building, including, for example, a staggered or brick pattern or an aligned or standard pattern. It should also be noted, however, that the wall panel system of the present invention can be used to create decorative wall panels, for example, installed on an interior or exterior wall.

The panels of the various embodiments can be constructed of various shapes and sizes, and in many cases are made of metal, such as aluminum, titanium, stainless steel, etc. The outer surface or front facing surface of the panels may be painted virtually any color or include other decorative features thereon.

A press brake or panel folder can be used to create or form the panels of the various embodiments of the present invention. For instance, in at least one embodiment, each panel is a single sheet of metal or other material that is formed, for example, but not limited to via a press brake or panel folder, to create the final panels as described and depicted herein. The system of at least one embodiment can include a tab-and-slot attachment assembly that accurately aligns at least some of the panels, e.g., along the x-, y- and z- axes, thereby increasing the speed of installation while maintaining a properly aligned finished wall surface and joint distances. The tabs and slots are strategically located based on a number of different parameters such as the width, length, engineering criteria, distance to the edge of the panel, etc.

Furthermore, the tab-and-slot attachment assembly of the present invention is designed to be used in either the horizontal or vertical joint line and can be used with materials of various thicknesses, such as, but not limited to a material thickness of approximately 0.063 inches through 0.188 inches.

As disclosed herein, in accordance with at least one embodiment, the system includes a starting bracket aligned along the bottom edge of the wall. The starting bracket of at least one embodiment includes one or more elongated slots which will cooperate with or otherwise receive corresponding tabs disposed on the bottom or starting panels.

In another embodiment, however, the bottom or starting panels may include an inwardly or upwardly directed attachment edge that can be affixed to the support structure via an attachment zee or other like bracket. In this case, the bottom panel does not include or otherwise does not need a downward tab for interconnection with a starting bracket.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
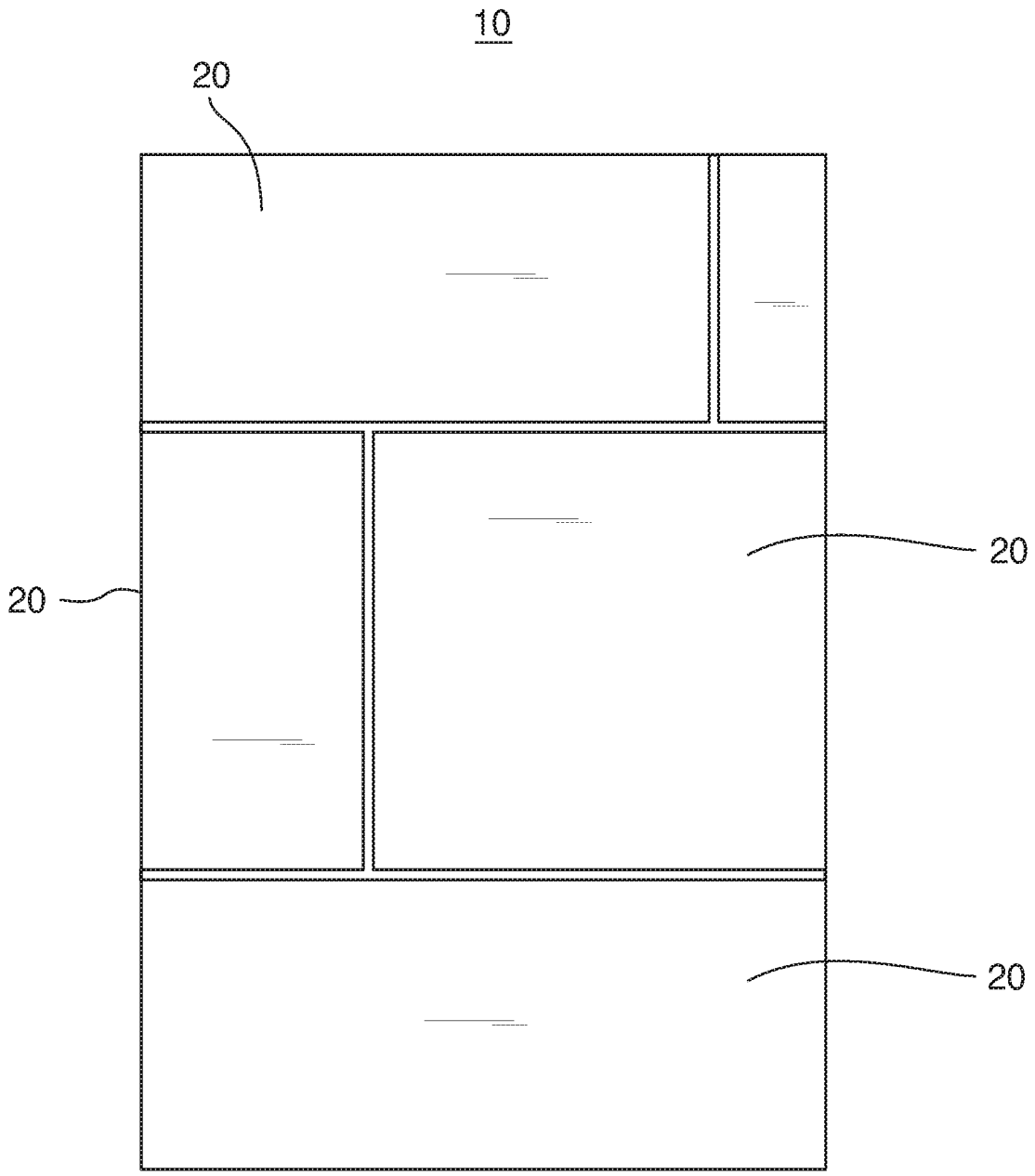
FIG. 1 is a front view of an exemplary wall panel installation as disclosed in accordance with at least one embodiment of the present invention.

As shown in the accompanying drawings, and with particular reference to FIG. 1, for example, the present invention is directed to a wall panel system generally referenced as 10. Specifically, the wall panel system 10 of the various embodiments includes a plurality of panels 20 assembled and installed or otherwise attached, either directly or indirectly, to the outer surface of a building, including but in no way limited to commercial buildings, office buildings, etc. The wall panel system 10 of the present invention is or can be considered a rain screen system or rain screen cladding, which is or includes an outer layer of material (often but not always made of metal, such as aluminum, titanium or stainless steel) designed to shed water from the exterior surface of the building. The panels 20 can be arranged in a number of different configurations along the exterior of the building, including, for example, a staggered or brick pattern (e.g., FIG. 1) or an aligned or standard pattern (e.g., FIG. 5A).

Figure 2A:
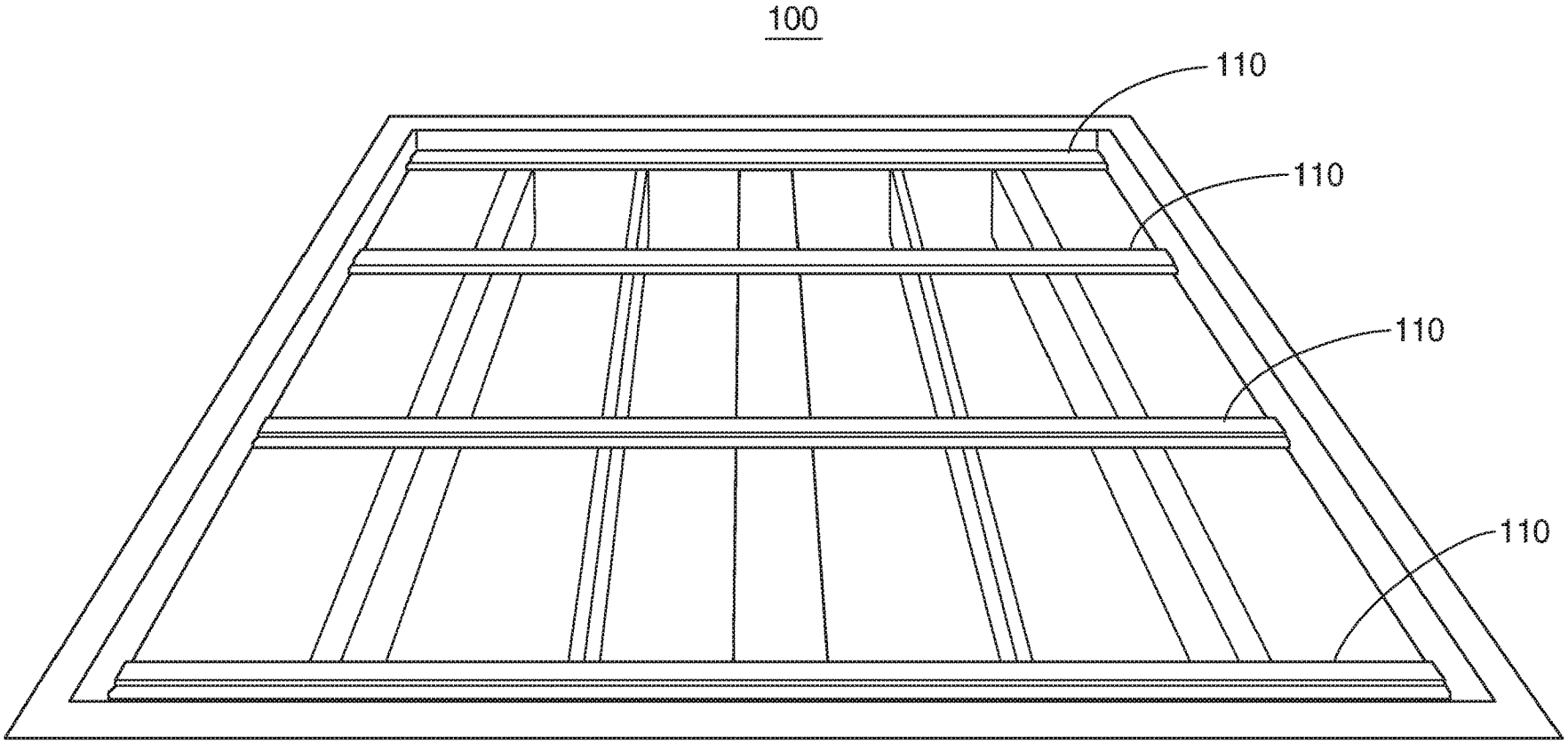
FIG. 2A is a perspective view of an exemplary support structure, e.g., in the form of a subgirt assembly, to which a plurality of panels are attached as disclosed in accordance with at least one embodiment of the present invention.
Figure 2B:
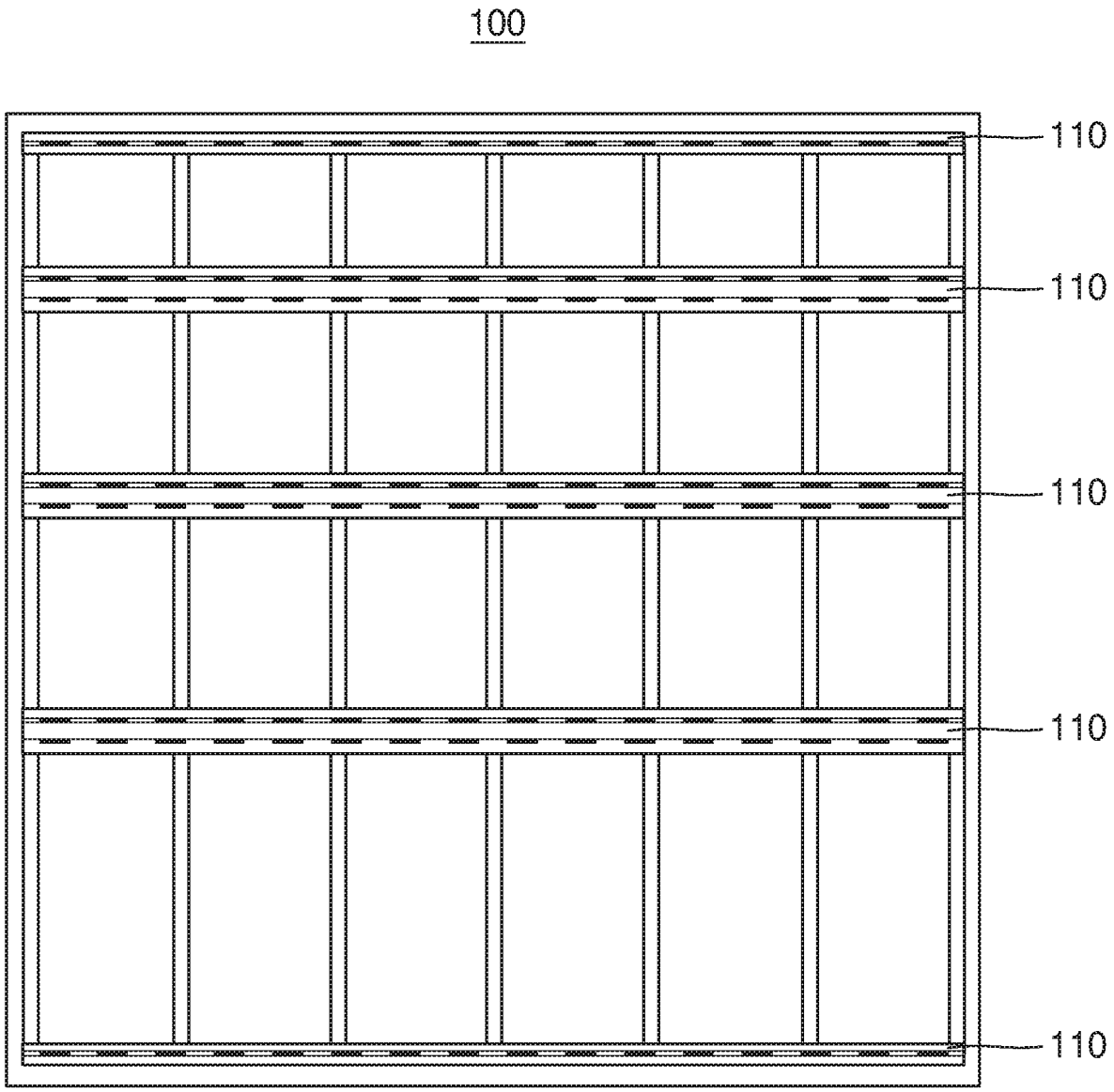
FIG. 2B is a front plant view of an exemplary subgirt layout as disclosed in accordance with at least one embodiment herein.
Figure 2C:
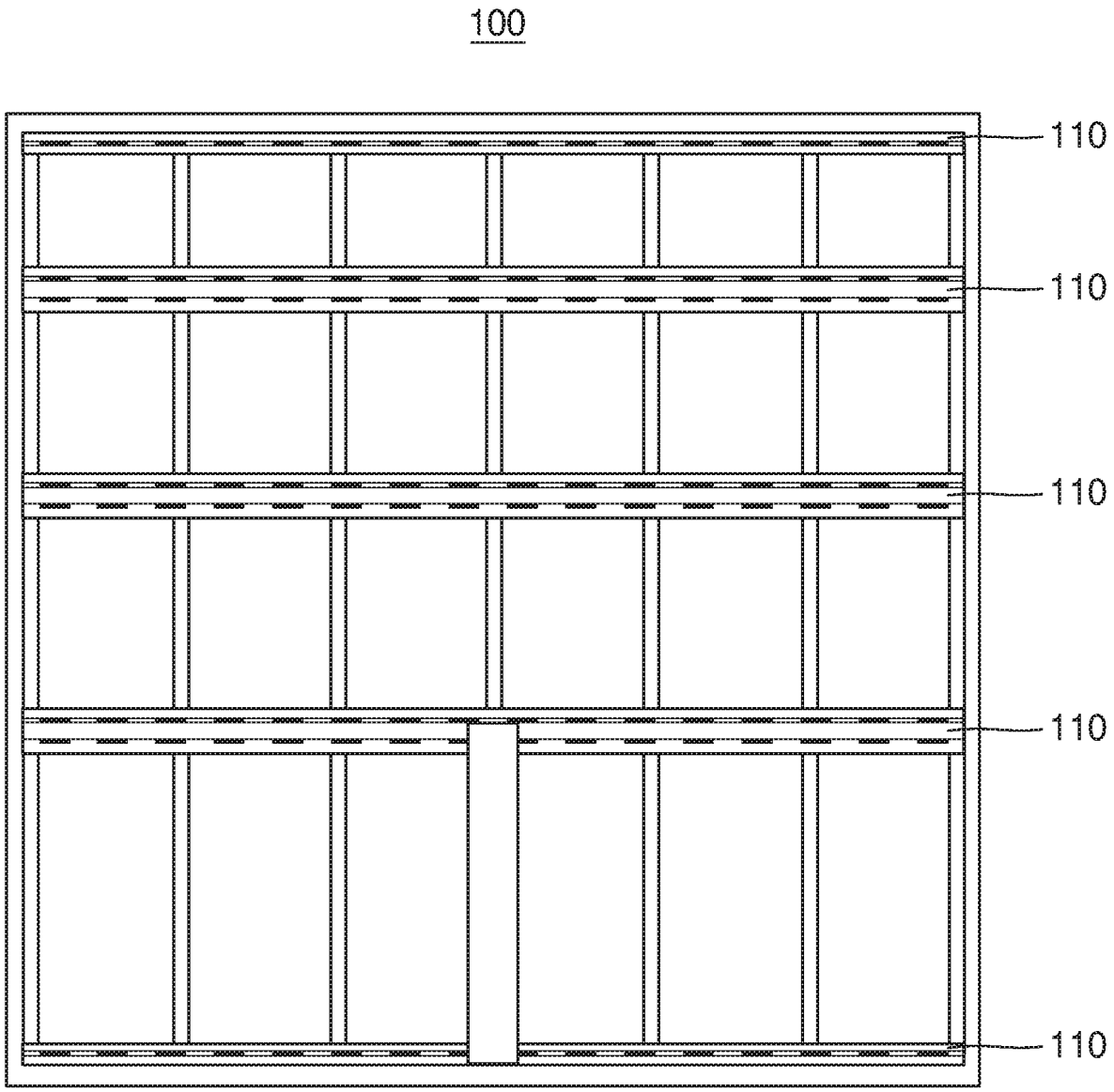
FIG. 2C is a front plan view of a vertical trim layout as disclosed in accordance with at least one embodiment of the present invention.

In addition, the system 10 of at least one embodiment includes a support structure 100 which is configured to support the plurality of panels 20. In particular, the support structure 100 may be in the form of a subgirt assembly comprising a plurality of framing girts 110 or rails, for example, vertical and/or horizontal girt rails to which the plurality of panels 20 are secured or attached. FIGS. 2A, 2B and 2C illustrate some exemplary subgirt assembly layouts that can be used in connection with the various embodiments of the present invention. Of course, these are provided merely for exemplary purposes and should not be deemed limiting in any manner.

It is also contemplated that the support structure 100 to which the plurality of panels 20 of the wall system 10 of the present invention secure or attach may be the structural siding or wall of the building itself. In such a case, a separate subgirt assembly may not be needed or be necessary.

In any event, the plurality of panels 20 are structured and designed to shed or deflect water while the support structure may provide structural support for the panels and the building, insulation, as well as extra water or weather protection. The panels 20 create an inner air space 15 that allows any moisture that passes through the panels 20 to drain to the exterior of the building.

More in particular, with reference to FIGS. 3A, 3B, 3C and 3D, at least one embodiment of the wall panel system 10 of the present invention is illustrated. For instance, as described above, the wall panel system 10 includes a plurality of panels 20 secured to a support structure 100. In particular, the panels 20 include at least one, but more practically a plurality of bottom panels 30 (FIG. 3B) aligned in a laterally adjacent or side-by-side manner along the bottom edge of the building or otherwise along the bottom edge or starting edge of the particular installation of the wall panel system 10 (which may not be the bottom of the building).

A plurality of intermediate panels 40 (FIG. 3A) are then arranged in a pattern or configuration above the bottom panels 30. Finally, a row or layer of top panels 50 (FIG. 3C) may be arranged along the top edge of the installation. As mentioned above, the panels 20, including the bottom panels 30, intermediate panels 40 and top panels 50, may be arranged in various patterns, including a staggered pattern (where the side or lateral edges of vertically adjacent panels do not align) or a standard pattern (where the side or lateral edges of the vertically adjacent panels to align).

Figure 3A:
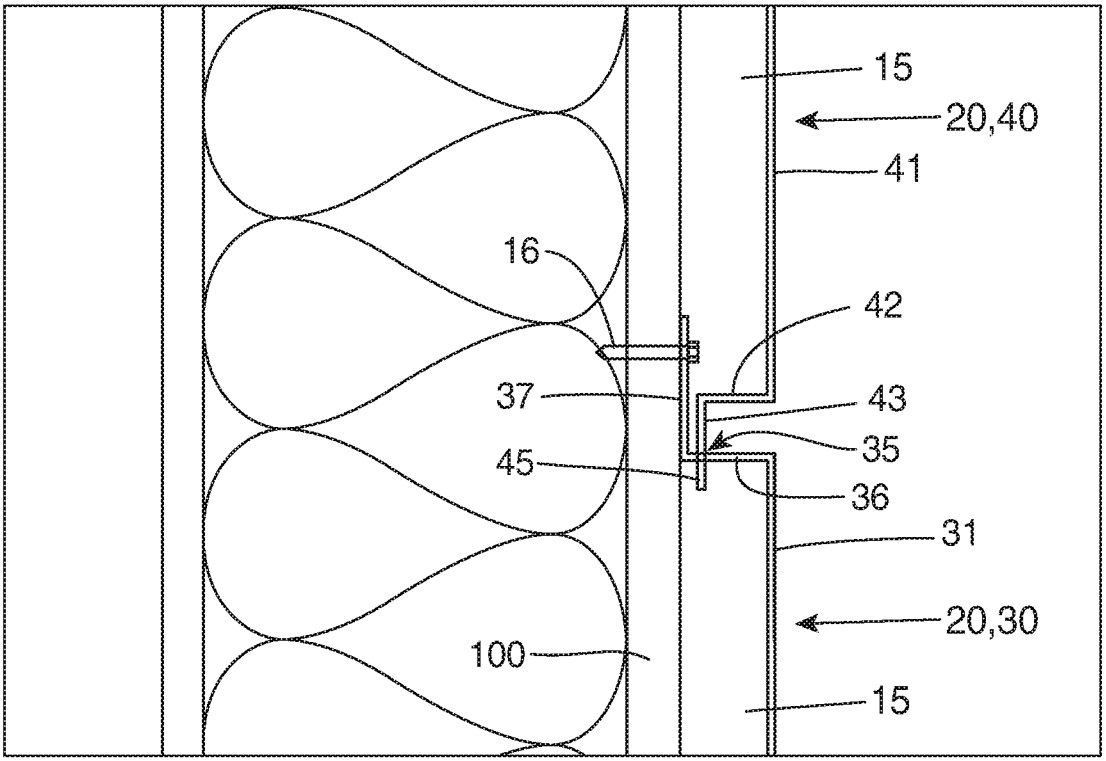
FIG. 3A is a partial side cut-away view illustrating a bottom or starting panel, an intermediate panel and the tab and slot attachment assembly therebetween.
Figure 3B:
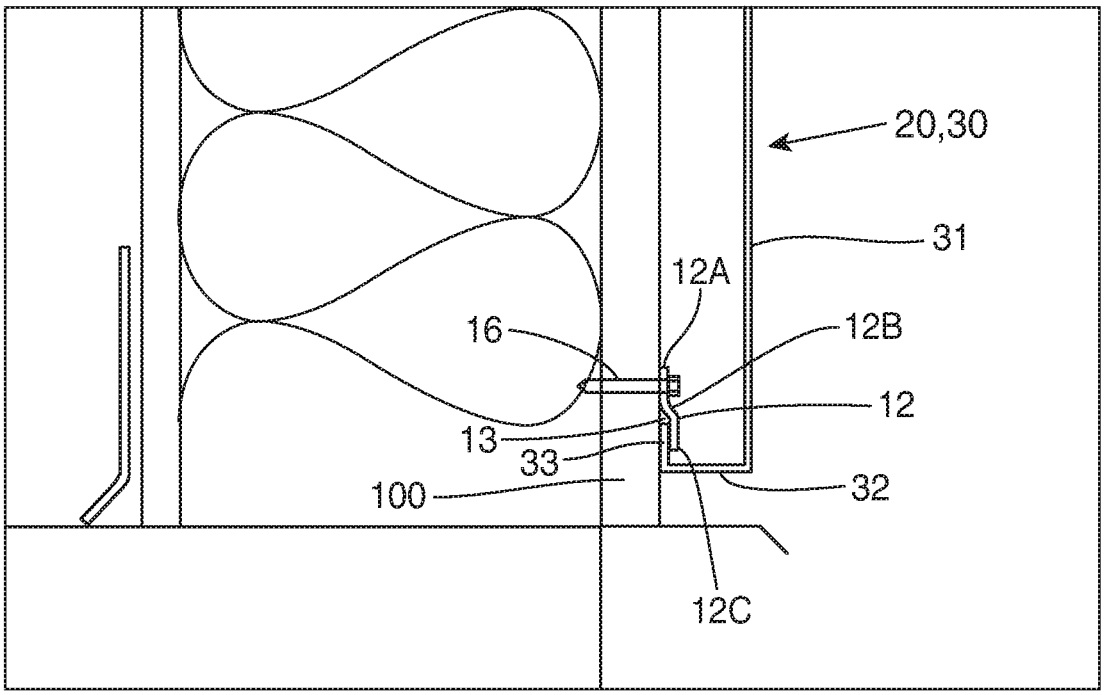
FIG. 3B is a partial side cut-away view illustrating a bottom or starting panel as disclosed in accordance with at least one embodiment of the present invention.

With reference to FIG. 3B, a side profile view of a bottom panel 30 of at least one embodiment is illustrated. In particular, the bottom panel 30 may include a front facing surface 31, a bottom edge 32 and a bottom attachment edge 33. In the illustrated embodiment, the bottom attachment edge 33 of the bottom panel 30 is disposed along a substantially vertical (or other) plane that is substantially parallel to the front facing surface 31. In other words, in at least one embodiment, the bottom edge 32 extends inward from the bottom of the front facing surface 31 of bottom panel 30, and the bottom attachment edge 33 of at least one embodiment, extends upward from the bottom edge 32. The bottom edge 32 may be angled ninety degrees from the front facing surface 31 and the bottom attachment edge 33 may extend ninety degrees from the bottom edge 32, resulting in the bottom attachment edge 32 being disposed along a plane at least substantially parallel to a plane of the front facing surface 31. Although, imperfections in the support surface 100, such as the wall of the building, may cause a slight deviation from the bottom attachment edge 33 being parallel to the front facing surface 21. Furthermore, the front facing surface 31 may not be completely flat and may instead include a curvature, wave pattern, angled pattern, etc. It should also be noted that the panel 20, 30 may be installed on any surface, whether vertical, horizontal or other angle in between.

Moreover, still referring to the exemplary embodiment of FIG. 3B, the bottom attachment edge 33 of bottom panel 30 extends upward and into the interior area 15 of the panel 30. In particular, the interior area 15 is defined as being a spaced open area between the front facing surface 31 of the panel 30 and the support structure 100 (e.g., the building itself or the subgirt assembly described above.) The bottom edge 32 of the bottom panel 30 separates the front facing surface 31 from the bottom attachment edge 33, and in some embodiments, includes a generally flat or planar configuration, as illustrated in FIG. 3B, for example.

Furthermore, in at least one embodiment, an attachment device or bracket, generally referenced as 12 and shown in FIG. 3B, for example, may be used to interconnect the bottom panel 30, and in particular, the bottom attachment edge 33 thereof to the support structure 100, such as the surface of the building, a frame, or a subgirt assembly, as described herein. Particularly, the attachment device 12, which may be in the form of an attachment zee, provides an interconnection between the bottom attachment edge 33 of the bottom panel, and the support structure 100, and may be disposed at least partially within the interior area 15, as shown and illustrated in FIG. 3B. One or more bolts, screws, or other fasteners 16 can be used to secure the attachment bracket or zee 12 to the support structure 100. The attachment bracket or attachment zee 12 may frictionally engage the attachment edge 33, for example, with the attachment edge 33 hooked or wedged between the attachment zee 12 and the support structure. However, in some embodiments, may be fixed to the attachment edge 12 via a fastener, adhesive, welding, etc.

Still referring to FIG. 3B, the attachment bracket 12 of at least one embodiment defines a pocket 13 within which the bottom attachment edge 33 of the bottom panel 30 is at least partially disposed or engaged. In other words, in at least one embodiment, and as illustrated in FIG. 3B, the pocket 13 defined by the attachment bracket 12 includes a downwardly-facing open end within which the bottom attachment edge 33 of the bottom panel 30 is disposed. In this manner, during installation, the bottom attachment edge 33 of the bottom panel 30 acts as a hook that can engage within the pocket 13 defined by the attachment bracket 12. Accordingly, once the bracket 12 is in place, the bottom panel 30 can be easily and quickly installed and ensure proper alignment.

Still referring to FIG. 3B, the attachment bracket 12 of at least one embodiment includes a base portion 12A secured to the support structure 100. At least one extension portion 12B extends from the base portion 12A in an angled direction to at least partially define the pocket 13. In some embodiments, the attachment bracket 12 includes two extension portions—a first extension portion 12B angularly extending from the base portion 12A and a second extension portion 12C angularly extending from the end of the first extension portion 12A. First and second extension portions 12B, 12C define the pocket 13 within which a portion of the bottom attachment edge 33 is disposed, as shown in FIG. 3A.

It should be noted that the embodiment shown with two extension portions 12B, 12C and base portion 12A define the attachment "zee," however, other attachment brackets with one extension portion or more than two extension portions are contemplated within the full spirit and scope of the present invention so long as the attachment bracket defines a pocket within which the bottom attachment edge 33 can be disposed or hooked.

Furthermore, while FIG. 3B shows an end or cut-away view of the attachment bracket 12, it should be noted that a single attachment bracket 12 may have an elongated configuration extending completely or substantially across an entire panel 30 (e.g., from one side 30A to the other side 30B). In other embodiments, a plurality of attachment brackets 12 may be disposed side by side or spaced to span from one side 30A to the other side 30B of a single panel 30. In yet another embodiment, a single elongated attachment bracket may extend or span between a width of a plurality of panels 30.

Turning now to FIG. 3A, the interconnection between a bottom panel 30 and an intermediate panel 40 of at least one embodiment of the present invention is illustrated. Specifically, the bottom panel 30 of one embodiment interconnects to an upper adjacent panel, such as an intermediate panel 40, via a cooperative tab and slot assembly. For instance, in the illustrated embodiment, the bottom panel 30 includes at least one elongated slot 35 (also shown in FIG. 5B) that cooperatively receives a tab 45 disposed on the bottom of the intermediate panel 40. Alternatively, although not illustrated, the bottom panel 30 could include a tab, in much the same manner as the intermediate tab 45, and the intermediate panel 40 could include a slot, in much the same manner as the bottom slot 35.

In any event, sill referring to FIG. 3A, the bottom panel 30 of at least one embodiment includes a top attachment edge 37 that extends upward or away from a top edge 36. For instance, top edge 36 of bottom panel 30 extends inward from the front facing surface 31 similarly to and in many cases parallel to the bottom edge 32. Top attachment edge 37 extends from, and in many cases, perpendicularly from, said top edge 36, and may be affixed to the support structure 100 via one or more fasteners 16, such as a screw, bolt, etc.

Figure 5A:
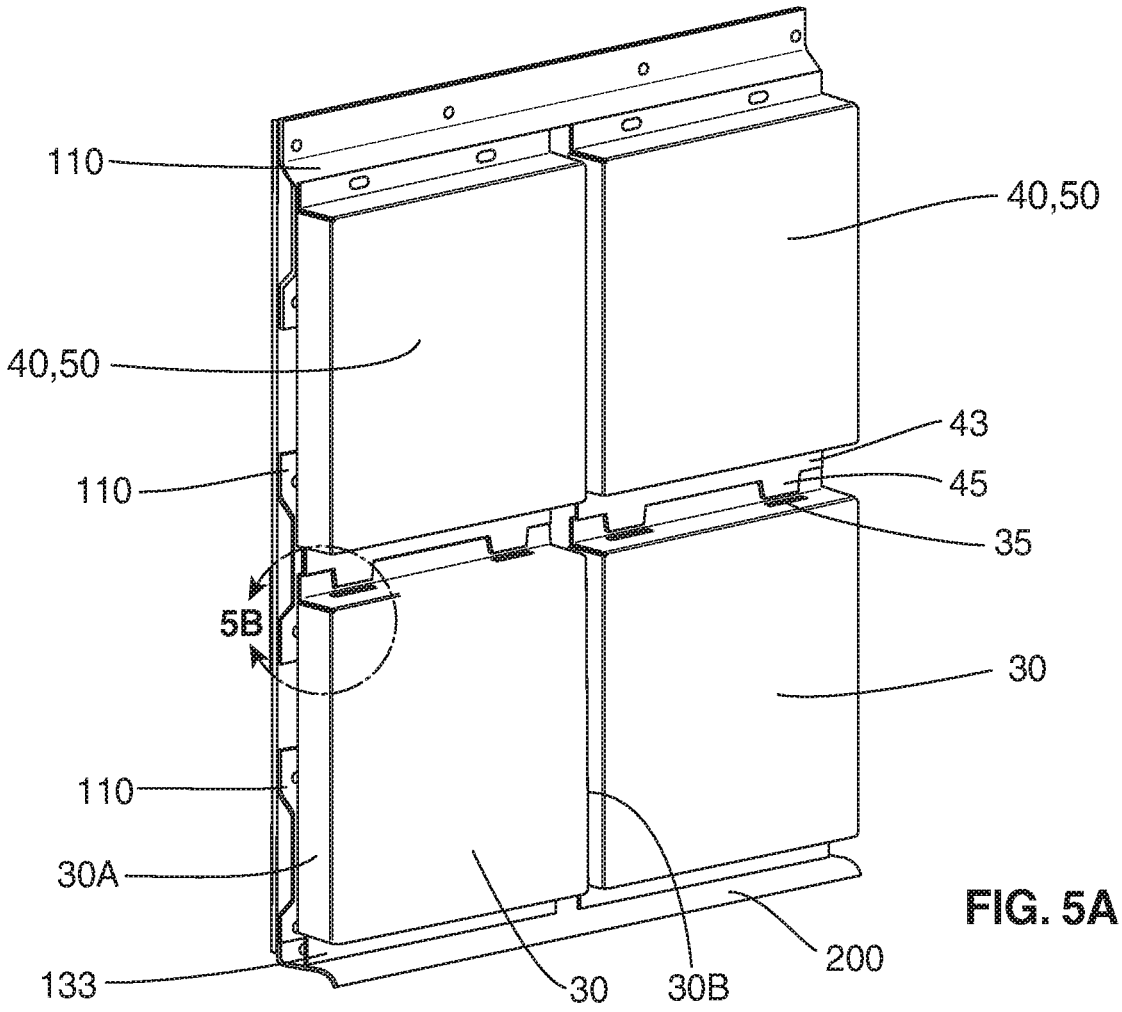
FIG. 5A is a perspective view of a wall panel system as disclosed herein in accordance with at least one embodiment.
Figure 5B:
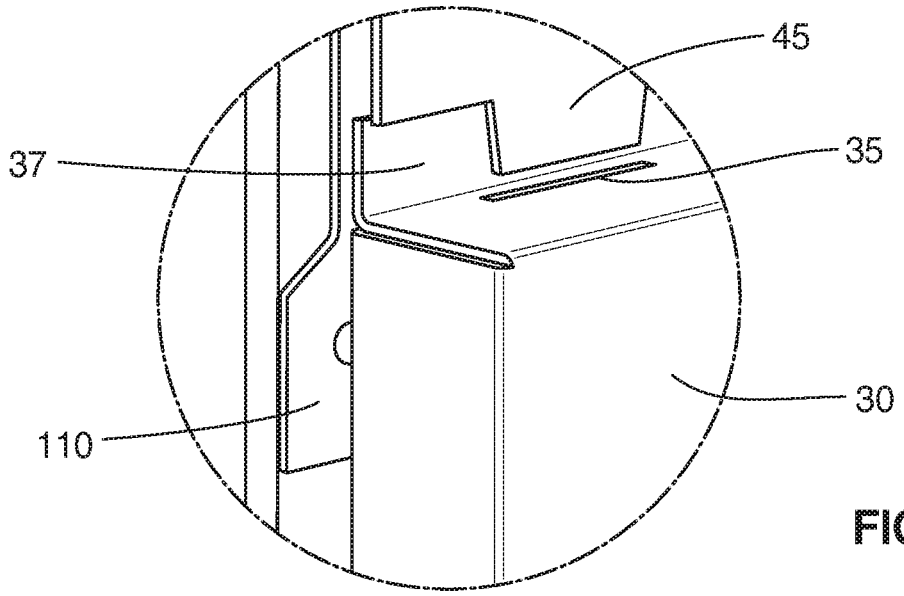
FIG. 5B is a close-up view of section 5B illustrated in FIG. 5A.
Figure 6:
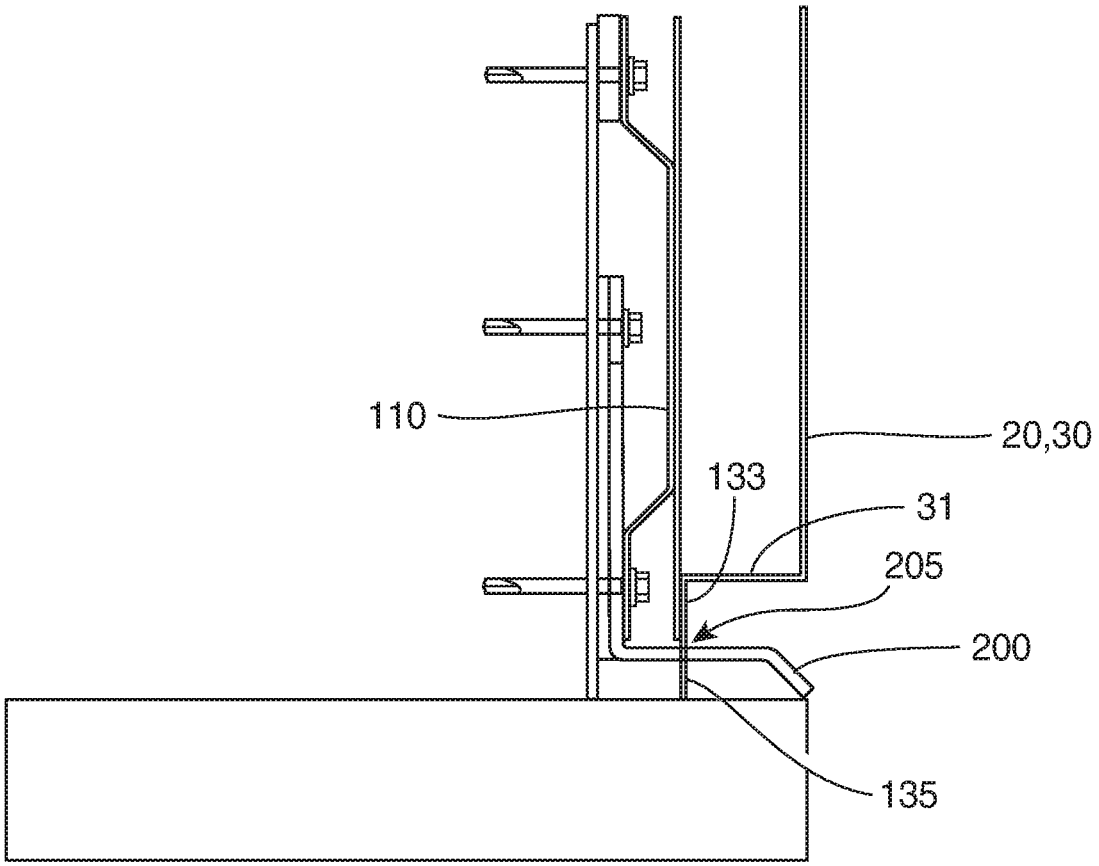
FIG. 6 is a partial side cut-away view of the bottom or starting panel as disclosed in yet another embodiment herein.
Figure 7:
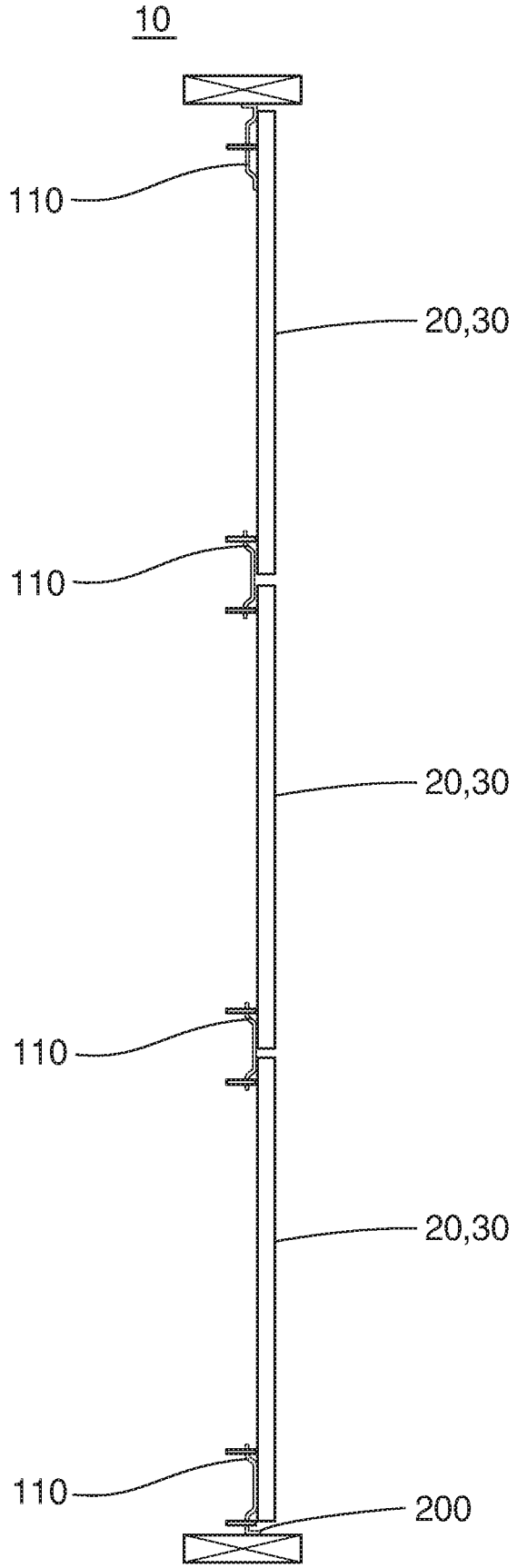
FIG. 7 is a side cut-away view of a bottom panel, an intermediate panel, and a top panel as disclosed in accordance with at least one embodiment of the present invention.

The slot(s) 35 of the bottom panel 30 are disposed along the top edge 36 between the top attachment edge 37 and the front facing surface 31. In particular, the slot(s) 35 include an elongated configuration (e.g., see FIG. 5B) that will cooperatively receive tab 45. For instance, the intermediate panel 40 includes a front facing surface 41, a bottom edge 42, bottom extension 43, tab 45, and a top edge. Similar to the bottom panel 30, the intermediate panel 40 of at least one embodiment includes an attachment edge extending upward from the top edge and one or more, e.g., two, slots disposed along the top edge thereof. Another intermediate panel, having a similar or identical construction, is configured to engage with the intermediate panel, to assemble the wall system 10. As best seen in FIGS. 5A and 5B, tab 45 extends from extension edge 43 in alignment with slot 35 for cooperative engagement or connection therebetween.

Figure 3C:
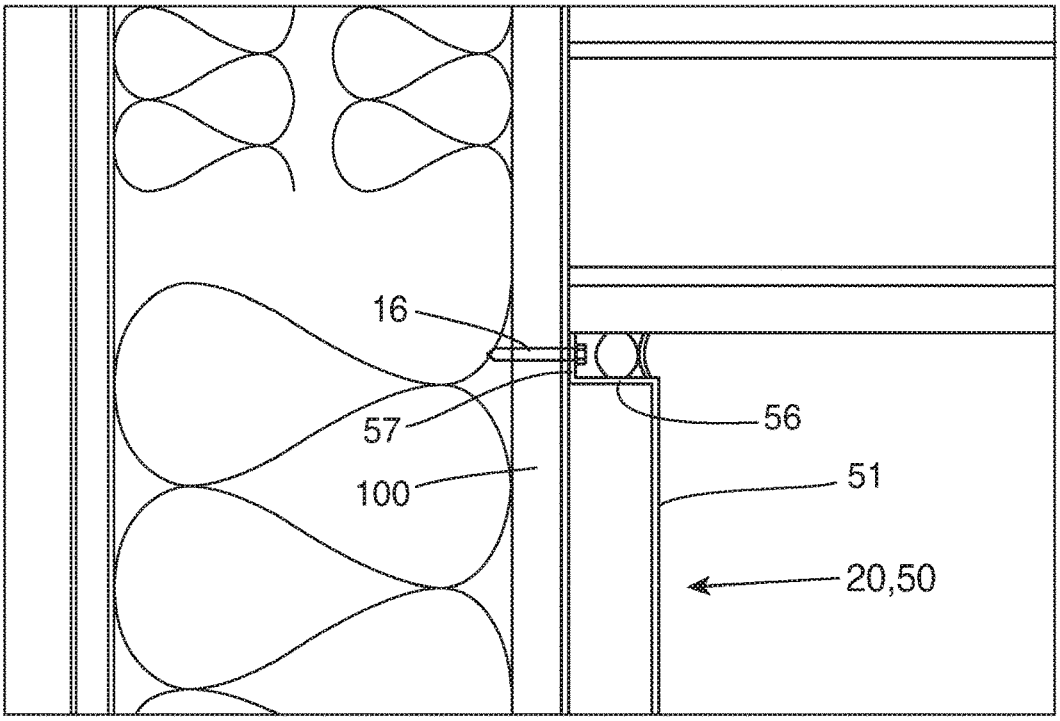
FIG. 3C is a partial side cut-away view illustrating a top panel as disclosed in accordance with at least one embodiment of the present invention.
Figure 3D:
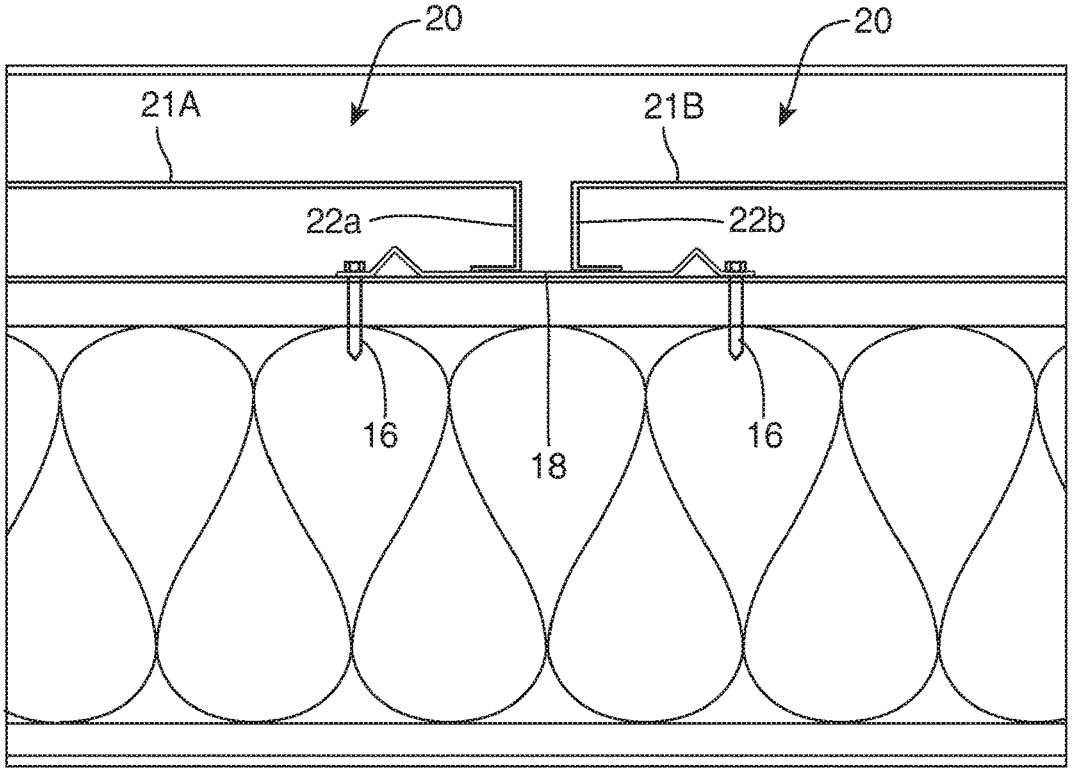
FIG. 3D is a partial cut-away view illustrating the horizontal space between horizontally adjacent panels as disclosed herein.

Referring again to FIG. 3A, the tab 45 is disposed in front of and in many cases parallel to the top attachment edge 37 of the corresponding bottom panel 30. This allows the tab 45 to cooperatively fit within the slot 35 for easy and efficient installation. FIG. 3C illustrates a partial side profile view of a top panel 50 which includes a front facing surface 51, a top edge 56 and a top attachment edge 57. Top edge 56 extends from the front facing surface 51 and terminates at the top attachment edge 57. One or more fasteners 16 may be used to secure the top attachment edge 57 to the support structure 100. FIG. 3D illustrates a downward cut-away view of two horizontally adjacent panels 20. In particular, the panels each include spaced apart side edges 22A, 22B extending from corresponding front faces 21A, 21B and terminating at corresponding attachment edges 23A, 23B. A bracket 18 spans between the two panels 20 and is secured to the support structure 100 via fasteners 16. Additional fasteners may be used to secure the panels 20 to the bracket 18.

Figure 4A:
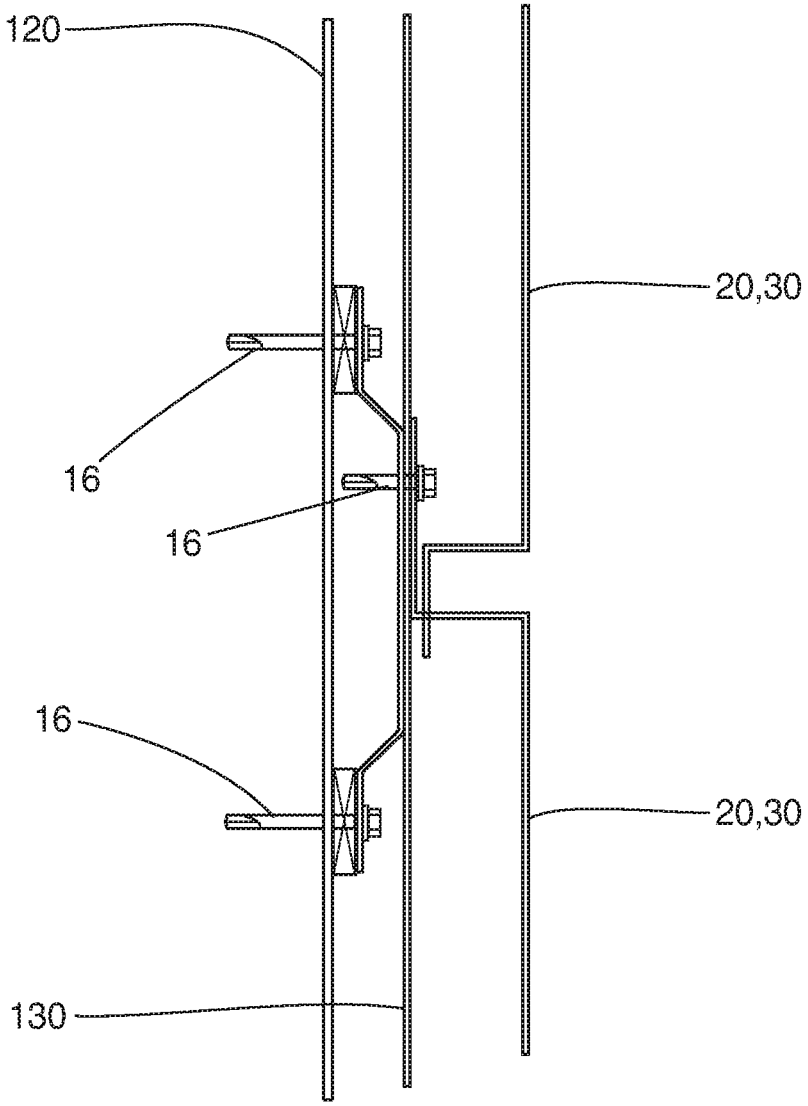
FIG. 4A is a partial side cut-away view illustrating a bottom or starting panel, an intermediate panel and the tab and slot attachment assembly therebetween as disclosed in accordance with another embodiment of the present invention.
Figure 4B:
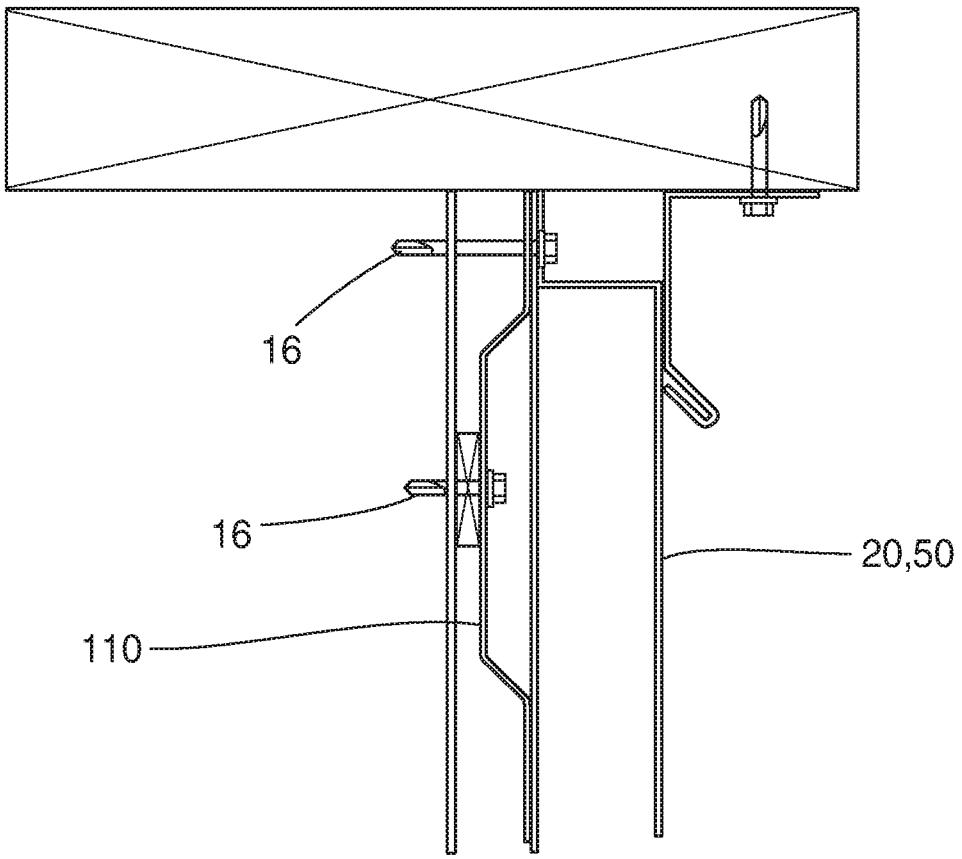
FIG. 4B is a partial side cut-away view illustrating a top panel as disclosed in accordance with at least one embodiment of the present invention.
Figure 4C:
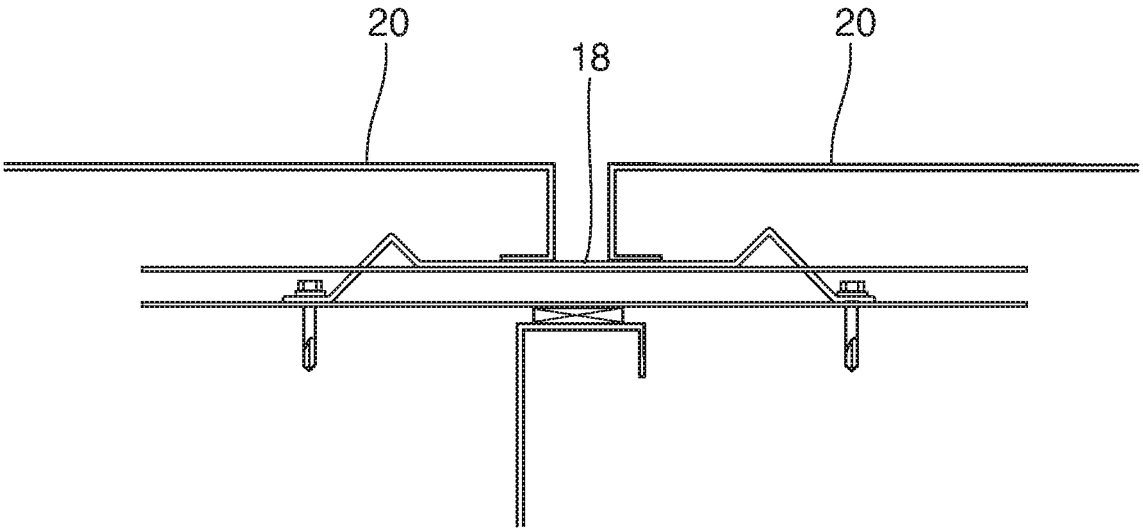
FIG. 4C is a partial cut-away view illustrating the horizontal space between horizontally adjacent panels as disclosed herein.

FIGS. 4A, 4B and 4C illustrate another embodiment wherein the wall panel system 10 is installed using a subgirt assembly 110 attached to the studs 120 of the building and the vertical trim 130 via a plurality of fasteners 16.

With reference to FIGS. 5A, 5B, 6 and 7, yet another embodiment is shown. In this embodiment, a starting bracket 200 is included. For instance, starting bracket 200 is disposed along the bottom or staring edge of the system 10 and includes a slot 205 similar in size and construction to slot 35 disclosed previously herein. In this embodiment, bottom panel 30 includes bottom extension edge 133 extending downward from bottom edge 31. Extending from bottom extension edge 133 is at least one, but more practically at least two, tabs 135 that cooperates with and is disposed within slot 205 of starting bracket 200. Staring bracket 200 may be secured to the support structure 100 and/or subgirt assembly via one or more fasteners 16.

With reference again to FIGS. 5A and 5B, it should be noted that in at least one embodiment, the slot 35 of the various embodiments herein may include a width that is slightly wider (e.g., 0.005 inches) wider that the thickness of the material used for the panels 20. In some embodiments, the slot 35 may be approximately 1.250 inches long, although other dimensions are contemplated within the full spirit and scope of the present invention.

In addition, the tabs 45, 135 of the various embodiments disclosed herein may be approximately 0.438 inches deep (e.g., measured from the end of the corresponding extension edge 43, 133 to the distal end of the tab 45, 135). The tabs 45, 135 may taper from 1.188 inches down to 1.063 inches. This allows the tabs 45, 135 to be easily inserted into the corresponding slot. The spacing between the tabs and the spacing between the slots can vary and may depend on the particular engineering of the particular project.

It should be noted that the various embodiments of the present invention, for example, the tab and slot attachment assembly, allows for a much easier installation and lower cost as opposed to other various implementation. This, therefore, cuts down on labor costs in the field, as well. It also allows for a thicker gauge material to be used. For example, on a project that may require large panels, the panels may be constructed out of thicker gauge material rather than adding stiffeners.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A wall panel system, comprising:

a plurality of wall panels comprising at least one bottom panel, at least one intermediate panel, and at least one top panel, said at least one bottom panel comprising a front facing surface, a bottom edge and a bottom attachment edge, an attachment bracket connecting said bottom attachment edge of said at least one bottom panel to a support structure, said attachment bracket comprising a base portion and at least one extension portion, said base portion being secured to the support structure and said at least one extension portion defining a pocket between the support structure and said at least one extension portion, and said at least one bottom panel being interconnected to said at least one intermediate panel via a tab-and-slot attachment assembly, wherein said bottom panel further comprises a top edge and a top attachment edge, said top edge extending inward toward the support structure from said front facing surface of said bottom panel, and said top attachment edge extending upward from said top edge, wherein said top edge of said bottom panel comprises at least one slot defined as an elongated hole disposed through said top edge, wherein said at least one intermediate panel comprises a front facing surface, a bottom edge, and a bottom extension, said bottom edge of said at least one intermediate panel extending inward from said front facing surface of said intermediate panel, and said bottom extension extending downward from said bottom edge, wherein said at least one intermediate panel further comprises at least one elongated tab extending downward from said bottom extension of said intermediate panel, said at least one elongated tab comprising opposing continuously tapered sides each starting at said bottom extension and terminating at a distal edge of said elongated tab, wherein said at least one elongated tab is disposable down and at least partially through said at least one slot defined on said top edge of said bottom panel.

2. The wall panel system as recited in claim 1 wherein said pocket defined by said attachment bracket comprises a downwardly-facing open end.

3. The wall panel system as recited in claim 2 wherein said bottom attachment edge of said at least one bottom panel is at least partially disposed within said pocket at least partially defined by said attachment bracket.

4. The wall panel system as recited in claim 1 wherein said attachment bracket comprises a zee bracket defined by said base portion and at least two extension portions.

5. The wall panel system as recited in claim 1 wherein said attachment bracket comprises a first extension portion angularly extending from said base portion and a second extension portion angularly extending from said first extension portion.

6. The wall panel system as recited in claim 5 wherein said bottom attachment edge of said at least one bottom panel extends upward toward an interior area of said at least one bottom panel.

7. The wall panel system as recited in claim 6 wherein said bottom attachment edge of said at least one bottom panel is at least partially disposed within said pocket at least partially defined by said attachment bracket.

8. The wall panel system as recited in claim 7 wherein said bottom edge of said at least one bottom panel is at least partially perpendicular to said bottom attachment edge.

9. The wall panel system as recited in claim 8 wherein said bottom edge of said at least one bottom panel is at least partially perpendicular to said front facing surface of said bottom panel.

10. The wall panel system as recited in claim 1 wherein said at least one bottom panel comprises at least two slots disposed in a spaced relation along said top edge of said at least one bottom panel.

11. The wall panel system as recited in claim 10 wherein said at least one intermediate panel comprises at least two tabs each configured to be disposed within a different one of said at least two slots of said at least one bottom panel.

12. The wall panel system as recited in claim 11 wherein said at least two tabs extend downward from said bottom edge of said intermediate panel.

13. The wall panel system as recited in claim 12 wherein said intermediate panel further comprises a top edge and an attachment edge, said attachment edge extending upward from said top edge, wherein said top edge of said intermediate panel defines at least two slots disposed there through.

14. A wall panel system, comprising:

at least one bottom panel, at least one intermediate panel, and at least one top panel, said at least one bottom panel comprising a front facing surface, a bottom edge and a bottom attachment edge, said bottom edge extending rearward of said front facing surface and said bottom attachment edge extending upward from said bottom edge, an attachment bracket comprising a base and at least one extension portion extending outward from said base to at least partially define a downwardly facing pocket when said base is attached to a support structure, wherein at least a portion of said bottom attachment edge is disposed within said pocket at least partially defined by said attachment bracket, said at least one bottom panel being interconnected to said at least one intermediate panel via a tab-and-slot attachment assembly, wherein said bottom panel further comprises a top edge extending rearward of said front facing surface of said bottom panel, wherein said top edge of said bottom panel comprises at least one slot defined as an elongated hole disposed through said top edge, wherein said at least one intermediate panel comprises a front facing surface, a bottom edge, and a bottom extension, said bottom edge of said at least one intermediate panel extending rearward from said front facing surface of said intermediate panel, and said bottom extension extending downward from said bottom edge, wherein said at least one intermediate panel further comprises at least one elongated tab extending downward from said bottom extension of said intermediate panel, said at least one elongated tab comprising opposing continuously tapered sides each starting at said bottom extension and terminating at a distal edge of said at least one elongated tab, said at least one elongated tab being disposable down and at least partially through said slot defined on said top edge of said bottom panel.

15. The wall panel system as recited in claim 14 wherein said attachment bracket comprises a zee bracket defined by said base portion and at least two extension portions.

16. The wall panel system as recited in claim 15 wherein said at least two extension portions of said zee bracket comprises a first extension portion angularly extending from said base portion and a second extension portion angularly extending from said first extension portion.

17. The wall panel system as recited in claim 16 wherein said bottom attachment edge of said at least one bottom panel extends upward toward an interior area of said at least one bottom panel.

* * * * *